United States Patent [19]

Terauchi

[11] 4,236,878

[45] Dec. 2, 1980

[54] LUBRICATION SYSTEM FOR COMPRESSOR UNIT

[75] Inventor: Kiyoshi Terauchi, Isesaki, Japan

[73] Assignee: Sankyo Electric Company Limited, Isesaki, Japan

[21] Appl. No.: 946,967

[22] Filed: Sep. 29, 1978

[51] Int. Cl.[3] ..... F04B 1/14

[52] U.S. Cl. ..... 417/269

[58] Field of Search ..... 417/269; 91/502

[56] References Cited

U.S. PATENT DOCUMENTS

| | | | |
|---|---|---|---|
| 3,085,514 | 4/1963 | Budzich | 417/269 |
| 3,712,759 | 1/1973 | Olson | 417/269 |
| 3,930,758 | 1/1976 | Park | 417/269 |
| 3,945,765 | 3/1976 | Toyada | 417/269 |
| 4,005,948 | 1/1977 | Hiraga | 417/269 |
| 4,011,029 | 3/1977 | Shimizu | 417/269 |
| 4,095,921 | 6/1978 | Hiraga | 417/269 |

FOREIGN PATENT DOCUMENTS

| | | | |
|---|---|---|---|
| 1,412,776 | 10/1972 | United Kingdom | 417/269 |

*Primary Examiner*—William L. Freeh

*Attorney, Agent, or Firm*—Hopgood, Calimafde, Kalil, Blaustein & Lieberman

[57] ABSTRACT

A lubrication system for a compressor unit includes a deflector depending from the inner wall of the compressor housing for directing the oil on the inner wall through a passageway of the front housing into the shaft seal cavity. A flange member extends from the depended end of the deflector along the inner wall of the compressor housing to prevent the oil flow directed to the shaft seal cavity from leaking into the interior of the compressor housing. A balance hole that permits a blow-by refrigerant gas to flow from the crank chamber into the suction chamber is formed in the cylinder block near the center thereof so that oil in the crank chamber is prevented from flowing into the balance hole. The compressor may also include a wobble plate supported by a bearing ball. A seat of the bearing ball is provided with an oil passageway which communicates with a crank chamber so that the bearing ball is lubricated.

8 Claims, 8 Drawing Figures

LUBRICATION SYSTEM FOR COMPRESSOR UNIT

BACKGROUND OF THE INVENTION

This invention relates generally to compressors and, in particular, to an improved lubrication system for a compressor unit.

A conventional compressor unit comprises a compressor housing having a crank chamber, a suction chamber and a discharge chamber, a cylinder block having a plurality of cylinders mounted in the compressor housing, pistons means slidably fitted within the cylinders, a front housing on the compressor housing including an opening as a shaft seal cavity for receiving a drive shaft, the drive shaft rotatably borne in the front housing through the shaft seal cavity, a crank disposed in the crank chamber for converting the rotating motion of the drive shaft into reciprocating motion to impart the reciprocating motion to the pistons, and suction and discharge valve means for controlling the flow of fluid between the suction chamber and each cylinder and between the discharge chamber and each cylinder.

In the conventional refrigerant compressor, a charge of refrigerant gas and lubricating oil is introduced. In the operation of the compressor, while the refrigerant gas is compressed by pistons reciprocating within corresponding cylinders, moving parts of the compressor must be lubricated by the lubricating oil.

The oil passes into the crank chamber together with the refrigerant gas as a blow-by gas through a gap between the piston and the inner wall of the corresponding cylinder to lubricate therebetween. The oil is separated from the refrigerant gas in the crank chamber and lubricates moving parts therein. A passageway or a balance hole is provided to return the refrigerant gas in the crank chamber to the suction chamber.

To lubricate a shaft seal assembly disposed within the shaft seal cavity and mounted on the drive shaft, an oil passageway is provided for communicating between the crank chamber and the shaft seal cavity.

A lubrication system for a compressor unit is disclosed in U.S. Pat. No. 4,005,948 to Hiraga wherein a deflector is formed depending from the inner wall of the compressor for collecting and then directing oil splashed onto the inner wall to a port or oil hole formed in the front housing in communication with the shaft seal cavity. Thus, the lubricating oil circulates between the crank chamber and the shaft seal cavity lubricating the shaft seal, bearings, and other moving parts.

But, in the arrangement disclosed in the Hiraga patent, the oil is not sufficiently used for lubricating moving parts because all oil collected and directed to the oil hole by the deflector does not flow into the oil hole but a part of the collected oil leaks into the crank chamber.

Moreover, to prevent the oil in the crank chamber from flowing into the balance hole in order to minimize the outflow of lubricating oil from the compressor, some constructions of the opening of the balance hole have been proposed. But these proposed constructions are comparatively complicated and make the compressor unit difficult.

SUMMARY OF THE INVENTION

An object of this invention is to provide an improved and more efficient lubrication system for a compressor unit.

Another object of this invention is to provide a lubrication system for a compressor unit wherein a greater amount of oil splashed onto the inner wall of the compressor housing is led into the shaft seal cavity from which the oil circulates into the crank shaft through bearings and other moving parts so that the lubricating oil is more efficiently used for lubricating the shaft seal and other moving parts.

It is yet another object of this invention to provide a compressor unit wherein the discharge of lubricating oil from the compressor is substantially reduced with a simple construction.

It is still another object of this invention to realize the above objects with a simple construction.

According to an aspect of this invention, a deflector member depending from the inner wall of the compressor housing is provided with a flange member extending along the inner wall of the compressor housing to a space for storing oil collected by the deflector member so that the collected oil is securely introduced into the oil hole in communication with the seal cavity without leakage.

In another aspect of this invention, an oil passageway communicating between the shaft seal cavity and the crank shaft is formed through the drive shaft and crank to open in the crank chamber at a peripheral surface of the crank means so that a sucking action inside the crank chamber is strengthened.

In yet another aspect of the invention, the balance hole is formed in the cylinder block near the center thereof so that the oil flow into the balance hole is prevented because oil flows away from rather than near the center of the compressor by the centrifugal forces imparted by the rotation of the crank acting on the oil.

In still another aspect of this invention, the compressor, which includes a crank comprising a cam rotor having a sloping surface mounted on the drive shaft, a wobble plate nutatably disposed between the sloping surface and a bearing ball seated in a ball supporting member provided with means to efficiently lubricate the ball seat.

Further objects, features and other aspects of this invention will be understood from the following detailed description of preferred embodiments of this invention referring to the annexed drawings.

DETAILED DESCRIPTION OF PREFERRED EMBODIMENTS

Figure 1:
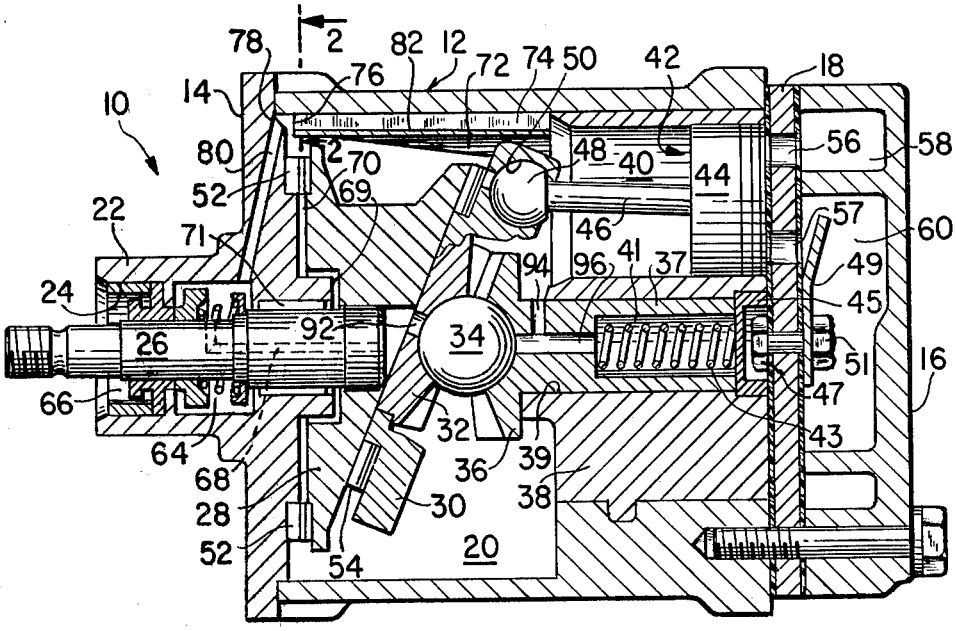
FIG. 1 is a vertical cross-sectional view of a compressor unit according to an embodiment of this invention.

Referring to the embodiment of the invention illustrated in FIG. 1, there is shown a compressor generally designated 10 which includes a substantially cylindrical housing 12 having a front housing or cover plate 14 at one end and a cylinder head 16 secured to its opposite end by any suitable means such as screws. A valve plate assembly 18 is interposed between housing 12 and cylinder head 16.

The interior of housing 12 defines a crank chamber 20 at its front end and cover plate 14 includes a central hub 22 having a central opening 24 through which a main shaft 26 passes into the interior of housing 12. At its inner end, shaft 26 is attached by any suitable means to a swash plate or cam rotor 28, such that cam rotor 28 is rotated along with shaft 26. The outer end of shaft 26, which extends outwardly from the compressor housing, is adapted to be driven, such as by a conventional clutch and pulley connection, to the motor of the vehicle in which the compressor is contained.

The sloping surface of cam rotor 28 is placed in close proximity with the surface of a wobble plate 30 mounted on an oscillating bevel gear 32. The latter is able to nutate or oscillate about a ball bearing 34 seated within a fixed bevel gear 36.

A cylinder assembly or block 38 is provided within housing 12 and, in the embodiment shown, has five cylinders 40 formed therein. Each cylinder receives a piston 42 having a head 44 and a rod 46 attached at one of its ends to a ball 48 which is received in a socket 50 formed in wobble plate 30. It should be understood that although only one such ball-socket connection is shown in FIG. 1, in the embodiment shown there are five such sockets arranged peripherally around the wobble plate to respectively receive the five pistons employed in the disclosed embodiment. A thrust bearing 52 is positioned between the adjoining surfaces of cam rotor 28 and front housing 14, and a similar thrust bearing 54 is interposed between the adjoining surfaces of the cam rotor 28 and wobble plate 30. The cylinder head 16 of the compressor is shaped to define a suction chamber 58 and a discharge chamber 60. The valve plate assembly 18 is provided with valve suction ports 56 connecting between the suction chamber 58 and respective cylinders 40, and valve discharge ports 57 connecting between the discharge chamber 60 and respective cylinders 40.

The front housing 14 of the compressor is shaped to define a shaft seal cavity 64 which contains a shaft seal 66, both of which are concentrically disposed about drive shaft 26. Shaft seal cavity 64 communicates with an oil passageway 68 formed axially in the drive shaft 26.

In the operation of the compressor, as is known, oil in the crank chamber 20 is agitated and lubricates the internal moving parts in the form of oil mist. An oil-refrigerant mixture, which is discharged from the compressor, is returned to the compressor through an inlet port (not shown) into the suction chamber 58 where the refrigerant is introduced through the suction valve port 56 into the cylinder 40 where it is compressed by the reciprocating movement of the pistons 42 caused by the nutation of the wobble plate 30 imparted thereto by the rotation of the cam rotor 28. The compressed oil-refrigerant mixture is partly discharged into the discharge chamber 60 from where it leaves the compressor to an external refrigeration system through an outlet port (not shown). A portion of the oil-refrigerant mixture passes into the crank chamber 20 as a "blow-by gas" through a closed gap between an inner wall of the cylinder 40 and the piston 42, where the oil is separated from the blow-by gas and is utilized to lubricate the moving parts of the compressor again.

Passageway 68, through which lubricating oil is passed over thrust bearing 54, effects communication between the shaft seal cavity and the crank chamber. The clearances 69 between the needle rollers of a main bearing 71 also work as communicating passageways of oil from the shaft seal cavity to the crank chamber.

In order to effectively use oil in the crank chamber for lubricating the shaft seal and other moving parts, the aforesaid U.S. Pat. No. 4,005,948 to Hiraga discloses a lubrication system including a deflector projecting from the inner wall of the compressor housing which collects lubricating oil splashed onto the housing wall and channels the lubricating oil thus collected to the shaft seal cavity. Namely, an oil deflector 72 projects into the crank chamber 20 from the inner wall of the compressor housing, as shown in FIG. 1. The deflector 72 may be in the form of a right triangle, as viewed in plan, having a surface 74 which tapers toward the front end of the housing and terminates in a flat tip 76 which touches the inner wall of front housing 14 adjacent but offset from an oil opening 78 formed in front housing 14. Opening 78 communicates with shaft seal cavity 64 through an oil passageway 80 formed in the interior of front housing 14 and terminating at its lower end at the shaft seal cavity 64.

According to the arrangement disclosed in the aforesaid patent to Hiraga, the oil splashed onto the interior wall of the housing by the rotation of the cam rotor 28 is collected along the tapered surface 74 of deflector 72, and is thereby directed to flow along that surface to opening 78 into which the collected oil is passed. The lubricating oil that is directed in this manner to opening 78 flows through oil passageway 80 into the shaft seal cavity 64 from where it flows partly through passageway 68 to thrust bearings 54 and ball bearing 34, and to crank chamber 20.

In the arrangement disclosed in the Hiraga patent, all of the oil collected by the deflector does not flow into the passageway 80 through the opening 78 and a part of the collected oil leaks and flows down along the inside surface of the front housing and the inner wall of the compressor housing, without being used for lubricating the moving parts such as the shaft seal, bearings and others.

According to this invention, a flange member 82 extends from the end of the deflector 72 along the inner wall of the compressor housing to prevent the oil directed to the oil opening 78 by the oil deflector from leaking into the interior of the compressor housing.

Figure 2:
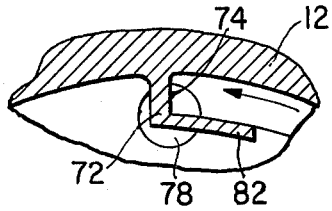
FIG. 2 is a sectional view taken along line 2—2 of FIG. 1.

Referring to FIG. 2, flange member 82 extends from the end of the deflector 72 at a side of the tapered surface 74 in an opposite direction of the oil flow on the inner wall of the compressor housing. A hollow portion, therefore, is formed between the inner wall of the housing and the flange member 82 along the tapered surface. This hollow portion serves to store the collected oil directed to the opening 78 by the side surface of the deflector. Thus, the collected oil is prevented from leaking into the interior of the housing without flowing into the opening 78.

Figure 3:
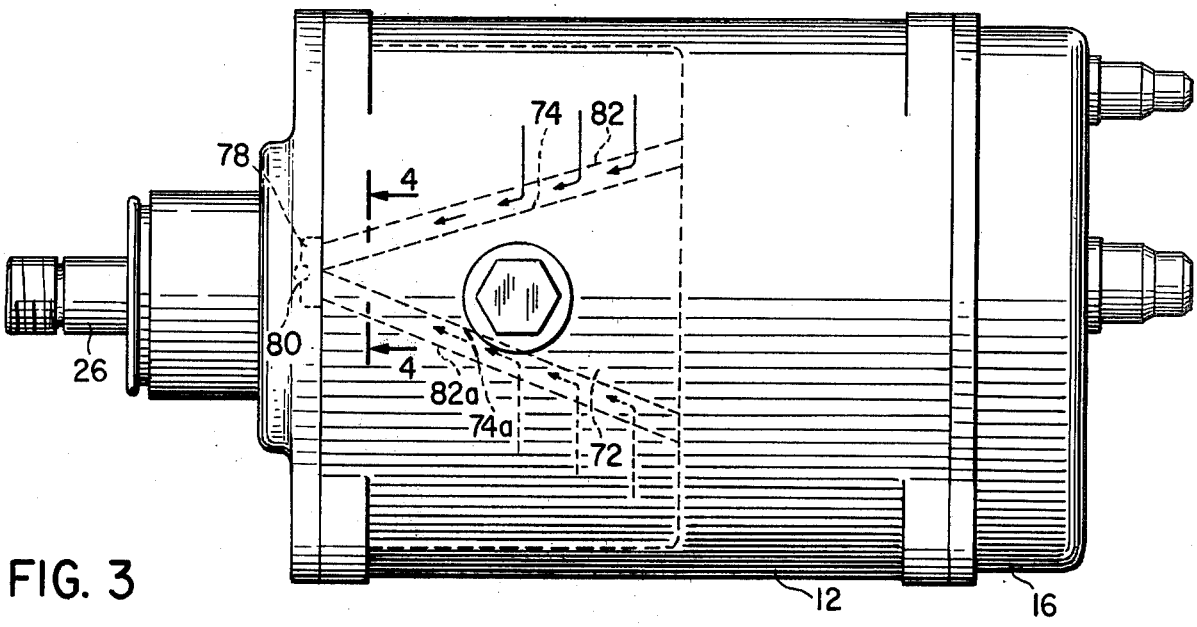
FIG. 3 is a plan view of a compressor unit according to another embodiment of this invention.
Figure 4:
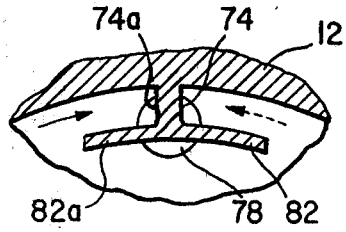
FIG. 4 is a sectional view taken along line 4—4 of FIG. 3, FIGS. 5*a* and 5*b* are respectively a sectional view and a perspective view of a drive shaft and cam rotor assembly in a compressor unit according to another embodiment of this invention.

If the deflector 72 is further provided with an opposite side tapered surface 74*a*, as shown in FIG. 3, the deflector 72 may be provided with another flange member 82*a* which extends along the inner wall of the compressor housing in an opposite direction to the flange member 82. In this arrangement, if the drive shaft and the cam rotor rotate in either direction, the oil on the inner wall of the housing is collected and directed into the opening 78.

The passageway 80 formed through the front housing 14 may comprise a passageway portion of an enlarged diameter connected to the opening 78 and another passageway portion of a reduced diameter connecting between the enlarged portion and the shaft seal cavity 64, similarly as the arrangement shown in FIG. 12 of U.S. Pat. No. 4,005,948.

Figure 5A:
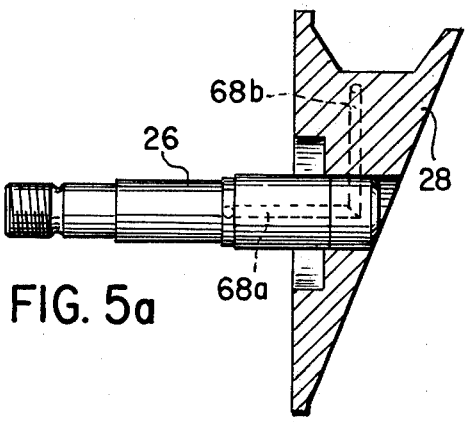
Figure 5B:
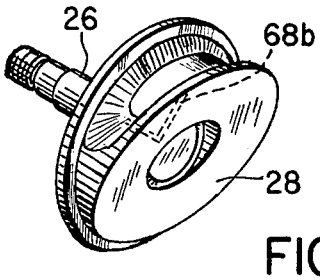

In another aspect of this invention, the passageway 68 formed in the drive shaft 26 may not open at the inner end thereof but instead opens at the peripheral surface of the cam rotor 28 through a passageway 68*b* which is radially formed through the cam rotor 28 and the end portion of the drive shaft 26, to connect with a passageway 68*a* axially formed through the drive shaft, as shown in FIGS. 5*a* and 5*b*.

In the arrangement shown in FIGS. 5*a* and 5*b*, since the rotating diameter of the opening of the radial passageway 68*b* is larger than the rotating diameter of the opening of the passageway 68*a* in the shaft which opens in the shaft seal cavity, the oil flow through passageways 68*a* and 68*b* from the shaft seal cavity 64 to the crank chamber is strengthened by the centrifugal force of fluid in the opening of the passageway 68*b*. Therefore, the oil flow from the opening 78 through the passageway 80 to the shaft seal cavity is also strengthened. Thus, the oil splashed onto the inner wall of the compressor housing is more effectively used for the lubrication of moving parts.

In another aspect of this invention, the balance hole is formed in the cylinder block 38 inside the circular row of cylinders 40.

Figure 6:
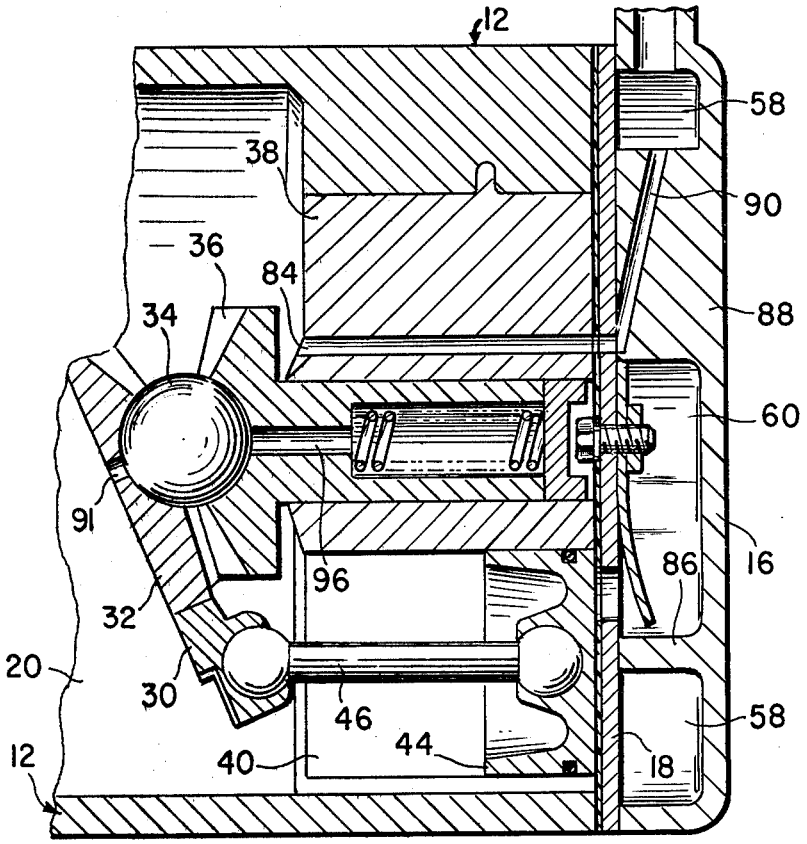
FIG. 6 is a cross-sectional view of the compressor shown in FIG. 1 taken along line 6—6 of FIG. 7, a front side portion being partially omitted.
Figure 7:
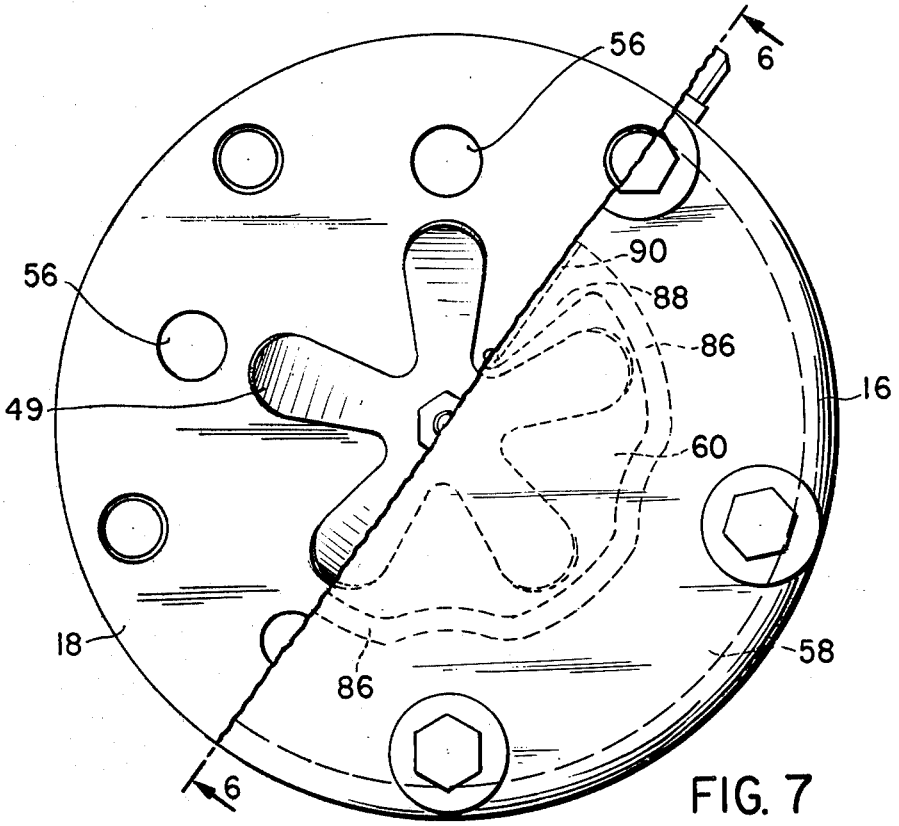
FIG. 7 is a rear end view of the compressor, with the cylinder head being partially cut away.

Referring to FIGS. 6 and 7, a passageway 84 is axially formed through the cylinder block 38 and the valve plate means 18 near the center thereof. A partition wall 86 of the cylinder head 16 separating the suction chamber 58 from the discharge chamber 60 is provided with a radially inwardly projecting wall portion 88, in which a passageway 90 is formed in communication with the passageway 84 and in communication with the suction chamber 58. Thus, the crank chamber 20 communicates with the suction chamber 58 through the passageways 84 and 90 so that the blow-by refrigerant gas may return to the suction chamber 58.

In the crank chamber 20, oil is splashed by the rotation of the cam rotor 28 and flows along the inner surface of the compressor housing and along the inner surface of the cylinder block 38. But the oil flow along the cylinder block surface is concentrated to the periphery as a result of the centrifugal forces of fluid inside the crank chamber. Therefore, oil does not flow into the balance hole 84–90. Thus, the formation of the balance hole is simple in comparison with the arrangement disclosed in the aforesaid Hiraga patent.

Referring again to FIG. 1, bearing ball 34 is lubricated by oil flowing out of the passageway 68 through a center hole 92 of the bevel gear 32. But oil is not fed between bearing ball 34 and fixed bevel gear 36 by the oil feeding to the ball 34 through the hole 92.

To achieve improved lubrication of the ball seat, according to another aspect of this invention, a radial passageway 94 is formed through the fixed bevel gear 36. Passageway 94, which is in communication with the crank chamber 20, opens in a depressed surface of the gear 36 which receives the bearing ball 34. In this arrangement, oil on the surface of the gear 36 flows into the passageway 94 to lubricate between the gear 36 and the ball 34.

In the embodiment of FIG. 1, a shank 37 of the fixed bevel gear 36 is axially slidably fitted into a central hole 39 of the cylinder block 38. The shank 37 is provided with an axial hollow portion 41 in which a coil spring 43 is disposed. A stopper 45 is screwed in the central hole 39 of the cylinder block 38, so that the spring 43 serves to axially force the gear 36 to the bearing ball 34. A nut 47, which serves to secure a discharge valve (not shown) and a valve stopper plate 49 to the valve plate means 18 in cooperation with a bolt 51, is disposed in a hollow of the spring stopper 45.

The shank 37 of the bevel gear 36 is also provided with an axial passageway 96, which communicates between the axial hollow portion 41 and the depressed portion of gear 36, which receives the bearing ball 34. The passageways 94 and 96 partially make a common portion, as shown in FIG. 1.

In the arrangement of FIG. 1, the compressed gas including oil mist in the discharge chamber 60 leaks into the hollow portion 41 and flows to the bearing ball 34 through the passageway 96. Accordingly, the ball 34 and the gear 36 are lubricated.

This invention has been described in detail in connection with preferred embodiments, which are intended only as exemplifications, and it is to be understood that modifications may be made therein without departing from the scope of this invention.

What is claimed is:

1. In a compressor including a compressor housing, a cylinder head having a suction chamber and a discharge chamber, a cylinder block mounted within said housing and having a plurality of cylinders, a plurality of piston means respectively slidably fitted within said cylinders to compress a refrigerant fluid, suction and discharge valve means for controlling the flow of fluid between said suction chamber and said cylinders and between said discharge chamber and said cylinders, a front housing on said compressor housing rotatably bearing a drive shaft for driving the compressor, means for converting the rotation of said drive shaft into reciprocating motion for imparting reciprocating motion to said piston means, a shaft seal assembly mounted on said drive shaft and within a shaft seal cavity formed in the front housing, means for effecting lubricating oil communication between said shaft seal cavity and the interior of said compressor housing, an oil deflector depending from the inner wall of said compressor housing, said front housing including an oil opening disposed adjacent said oil deflector and a passageway formed therein effecting oil communication between said oil opening and said shaft seal cavity, the improvement which comprises: a flange member extending from the depended end of said oil deflector along the inner wall of said compressor housing, said flange member forming with said oil deflector a groove in which oil directed to said oil opening by said oil deflector is collected and stored so that substantially all the directed oil flows into said oil opening without again flowing down along the inner surface of said compressor housing.

2. The improvement of claim 1, in which said oil deflector comprises a tapered surface, said flange member extending substantially transversely from a side of said tapered surface in a direction opposite to the direction of flow of oil on the inner wall of said housing.

3. The improvement of claim 2, wherein a hollow portion is defined between the inner wall of said housing and said flange member, said hollow portion being effective to store oil directed to said oil opening by said deflector.

4. The improvement of claim 2, in which said oil deflector comprises first and second converging tapered surfaces, and further comprising a second flange member extending from said second tapered surface in a direction opposite to said first flange member extending from said first tapered surface.

5. The improvement as claimed in claim 1, wherein said converting means comprises a cam rotor mounted on an inner end of said drive shaft and being in a wedge form having a sloping surface, and a wobble plate disposed between said sloping surface of said cam rotor and said cylinder block to wobble by the rotation of said cam rotor and connected to said piston means through piston rods, said oil communication means comprising a first passageway formed in said drive shaft between said shaft seal cavity and the peripheral surface of the drive shaft at the inner end thereof and a second passageway formed in said cam rotor between the inner surface thereof at the position registering to said first passageway and the peripheral surface thereof.

6. The improvement as claimed in claim 1 or 5, further comprising a balance hole formed through said cylinder block near the center thereof, one end of said balance hole opening in the interior of said compressor housing and the other end of said balance hole communicating with said suction chamber.

7. The improvement as claimed in claim 1, wherein said converting means comprises a cam rotor mounted on an inner end of said drive shaft and being in a wedge form having a sloping surface, and a wobble plate mounted on said sloping surface through a needle bearing therebetween and mounted on an oscillating bevel gear which is able to nutate or oscillate about a bearing ball seated within a fixed bevel gear, said fixed bevel gear having a shank fitted in a center hole of said cylinder block, means urging said fixed bevel gear to said bearing ball, said valve means including a discharge valve and a stopper plate secured to a valve plate by fastening means disposed in said center hole and in said discharge chamber, said fixed bevel gear being provided with a passageway opening in the seat of said bearing ball and communicating with a hollow portion of said center hole in which said urging means is disposed, whereby the compressed gas in said discharge chamber may leak to the seat through a gap around said fastening means and said passageway of the fixed bevel gear to lubricate between said fixed bevel gear and said bearing ball.

8. The improvement as claimed in claim 7, wherein said fixed bevel gear is provided with another passageway communicating between the bearing ball seat and said interior of the compressor housing.

* * * * *